US005630387A

United States Patent [19]

Kamiyama

[11] Patent Number: 5,630,387

[45] Date of Patent: May 20, 1997

[54] INTAKE MANIFOLD

[75] Inventor: Eiichi Kamiyama, Mishima, Japan

[73] Assignee: Toyota Jidosha Kabushiki Kaisha, Aichi, Japan

[21] Appl. No.: 613,520

[22] Filed: Mar. 11, 1996

[30] Foreign Application Priority Data

Mar. 13, 1995 [JP] Japan ..... 7-052489

[51] Int. Cl.[6] ..... F02M 35/10

[52] U.S. Cl. ..... 123/184.38; 123/198 D; 123/184.42

[58] Field of Search ..... 123/184.42, 184.38, 123/184.47, 184.61, 198 D

[56] References Cited

U.S. PATENT DOCUMENTS

| | | | |
|---|---|---|---|
| 5,012,771 | 5/1991 | Oda et al. | 123/184.38 |
| 5,050,701 | 9/1991 | Okui et al. | 123/184.42 |
| 5,476,080 | 12/1995 | Brunnhofer | 123/198 D |

FOREIGN PATENT DOCUMENTS

| | | |
|---|---|---|
| 63-24359 | 2/1988 | Japan . |
| 3-189058 | 8/1991 | Japan . |
| 6-257524 | 9/1994 | Japan . |

*Primary Examiner*—David A. Okonsky

*Attorney, Agent, or Firm*—Oliff & Berridge

[57] ABSTRACT

The specification relates to an intake manifold having an increased compaction. In this intake manifold, at least one fragile zone is formed parallel to its longitudinal axis in its wall. Crash impact is absorbed and the volume of the intake manifold decreases after crashing, because its cross section is crushed. The intake manifold of this invention has an increased compaction and can prevent the structure around fuel injection valves from breaking.

8 Claims, 5 Drawing Sheets

I
II
142a
143a
144a
142a
142a
143a
144a
142a 142b
142b
142b
142b
142a
142b
142a
142b 143c
142c
142c
144c
142c
142c 142d
142d

INTAKE MANIFOLD

BACKGROUND OF THE INVENTION

1. Field of the Invention

This invention relates to an intake manifold of an engine, and more particularly to an intake manifold having an increased crash-compaction.

2. Description of the Related Art

A body of an automobile is generally made so that it can absorb the energy of a crash by deforming an engine compartment which is located at the front or rear of the cabin in order to ease the impact of a crash.

In an automobile having its engine at a right angle to the vehicle running direction, that is, located sideways, an intake manifold made of a U-shaped plastic element which has fragile parts around it, has already been proposed, positioned at the side face of the engine, that is, positioned between the engine and a cowl panel (Japanese Unexamined Utility Model Application No. 63-24359). This intake manifold is capable of absorbing an impact of a crash.

The cubic volume of the above-mentioned intake manifold, however, does not decrease and the amount of compaction for absorbing an impact cannot be increased, because the above-mentioned intake manifold has fragile parts around it, and the manifold breaks along its fragile parts while maintaining its cubic volume.

SUMMARY OF THE INVENTION

Accordingly, an object of the invention to provide an intake manifold which has an increased crash compaction.

According to one aspect of this invention, there is provided an intake manifold connected to an outer side face of an engine which is located at a right angle to a vehicle running direction, and having at least fragile zone which has a direction component parallel to its longitudinal axis.

The intake manifold of this invention can be broken along the fragile zones of its longitudinal axis in order to absorb an impact of a crash, and has an increased crash compaction by deforming in its cross section.

According to another aspect of this invention, there is provided an intake manifold having fragile zones only at its center part.

The intake manifold of this invention can keep its normal cross section at its terminal end, and protect its connecting parts from breaking.

DETAILED DESCRIPTION OF THE PREFERRED EMBODIMENT

Figure 1:
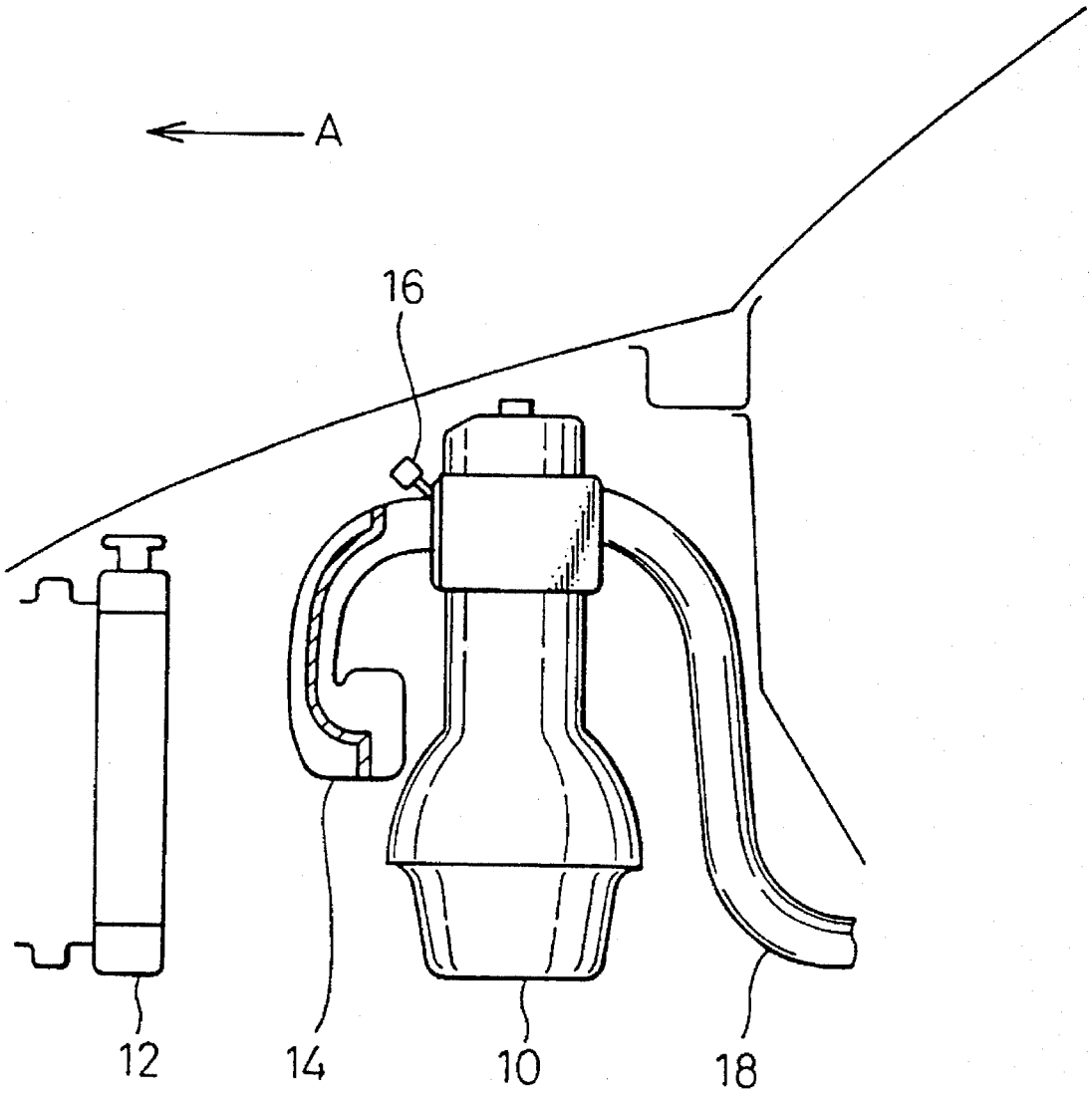
FIG. 1 is a partial cross-sectional view of an automobile.

FIG. 1 is a partial cross-sectional view of an automobile with its engine mounted at its front and utilizing an intake manifold of the present invention.

The engine 10 has four tandem cylinders, and the line of the cylinders is arranged at a right angle to the running direction of the automobile (shown by an arrow A), and a radiator 12 is provided at the front of the engine compartment.

An intake manifold 14 which supplies intake air to the engine 10 is located between the engine 10 and the radiator 12, and is connected to the front side face of the engine 10. Fuel injection valves which supply fuel to the engine 10 are located at the connection point between the intake manifold 14 and the engine 10. Further, an exhaust pipe 18 is connected to the rear side face of the engine 10.

Figure 2:
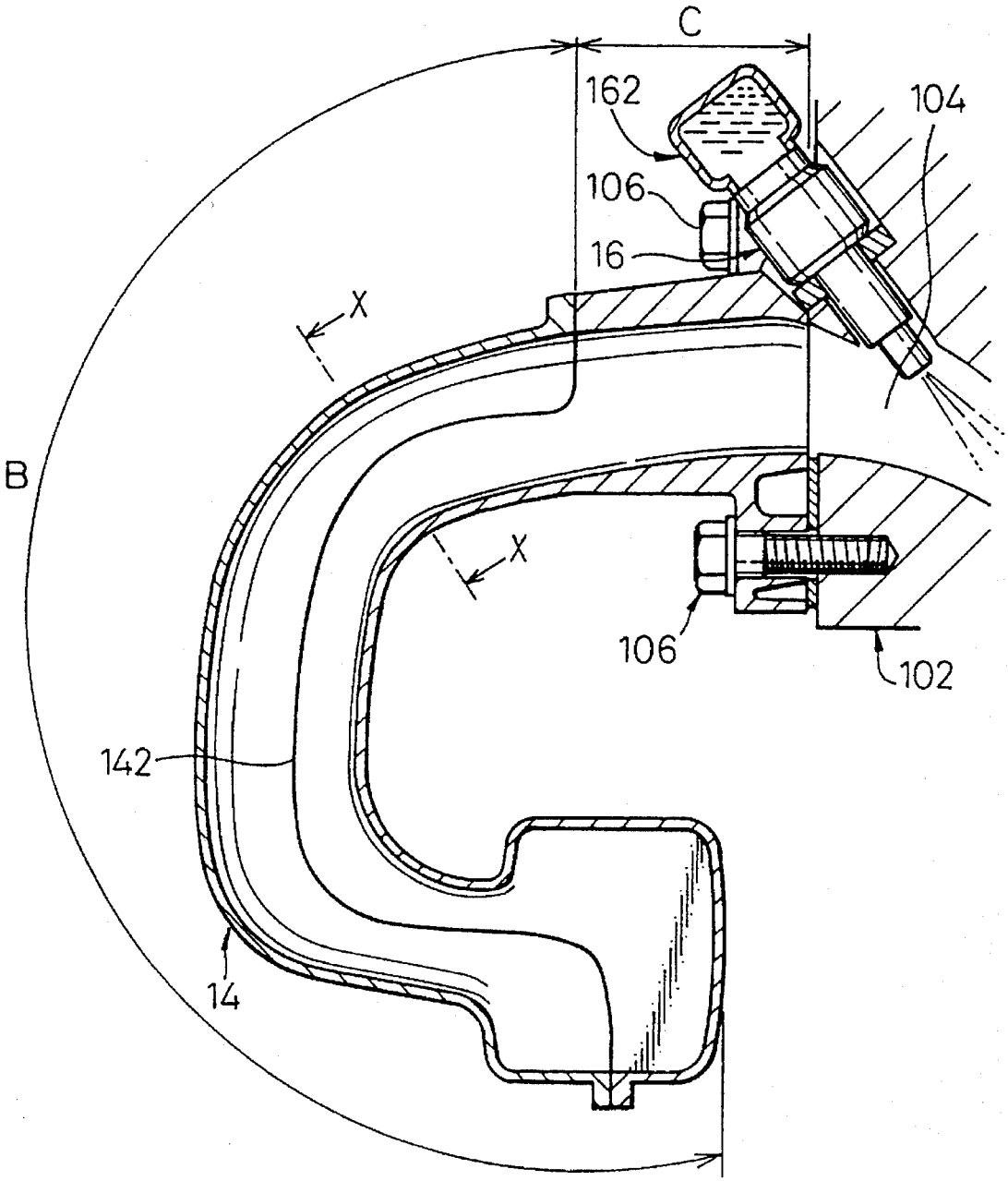
FIG. 2 is an enlarged drawing of the first embodiment of an intake manifold according to the present invention.

FIG. 2 is an enlarged drawing of the intake manifold 14, and a fuel injection valve 16 which injects fuel into an intake port 104 is mounted at a cylinder head 102. Note, fuel is supplied to the fuel injection valve through a fuel pipe 162. The intake manifold 14 which supplies intake air to the intake port 104 is fixed to the cylinder head 102 by bolts 106.

The intake manifold 14 is formed with a thin wall at the part (part "B") other than the part which connects to the cylinder head 102 (part "C"), and is formed as a U-shape. Further, the intake manifold 14 has at least one fragile zone 142 which extends parallel to its longitudinal direction for at at least a portion thereof.

FIGS. 3A through 3D are cross sectional drawings along a line X—X of FIG. 2, at the part "B" of the intake manifold 14, and four variations of the first embodiment are shown. The cross section before crashing is shown on the left, and the cross section after crashing is shown on the right.

Figures 3A, 3B, 3C, 3D:
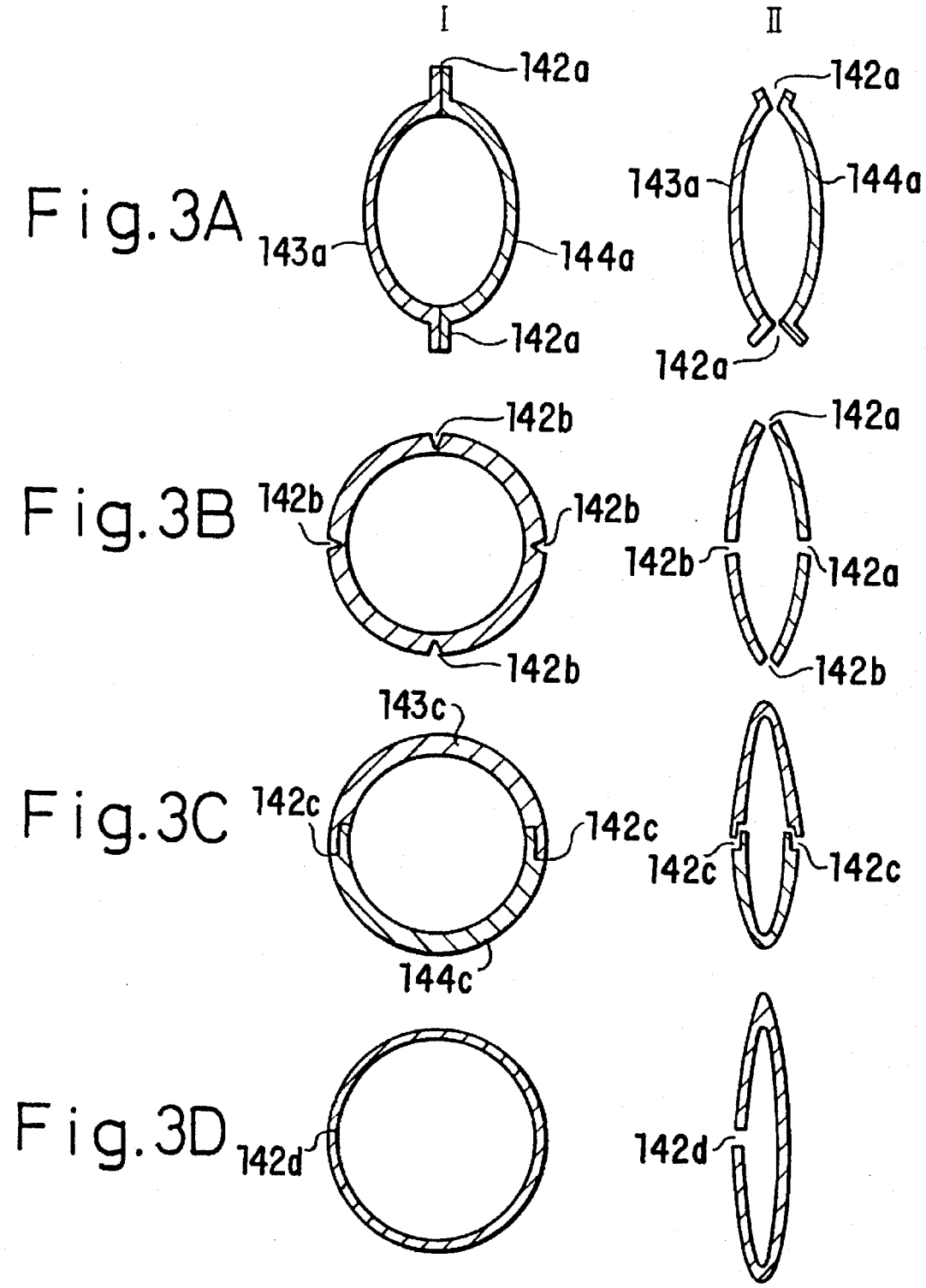
FIGS. 3A, 3B, 3C and 3D are cross-sectional drawings of an intake manifold along a line X—X in FIG. 2.

The first variation shown in FIG. 3A is structured by two half cylindrical elements 143 and 144 facing each other, and connecting portions function as fragile zones. That is, the connecting portions 142 come apart and the intake manifold 14 is broken by the impact of a crash in order to absorb the impact force and decrease the cross section of the manifold.

Note, it is preferable that when flanges are formed for connecting, the flanges are positioned at a right angle to the running direction of the automobile so that they do not function as reinforcing elements.

The second variation shown in FIG. 3B has four grooves on the outer surface of the intake manifold which function as fragile zones. Note, the grooves can also be formed on the inner surface, and at least one groove may be sufficient. In this case, the intake manifold 14 is broken along the grooves by the impart of a crash to absorb the impact force and decrease the cross section of the manifold.

The third variation shown in FIG. 3C is structured by two half cylindrical elements 143 and 144 facing each other, and connecting portions function as fragile zones. That is, the connecting portions 142 come apart and the intake manifold 14 is broken by the impact of a crash to absorb the impact force and decrease the cross section of the manifold. In this case, it is not necessary that the connecting portions are positioned at a right angle to the running direction of the automobile, and they may face the running direction, because they do not have thick walls as in the variation of FIG. 3A.

The fourth variation shown in FIG. 3D is structured by bending a plate to form the intake manifold, and a connecting portion (a seam) 142 functions as a fragile zone. In this case, the connecting portion 142 comes apart and the intake manifold 14 is broken by the impact of a crash to absorb the impact force and decrease the cross section of the manifold.

It is important in all cases, that the intake manifold 14 deform from its pipe structure, that is, the closed cross-sectional structure of the manifold perpendicular to the flowing direction of intake air should deform to an opened structure, because the opened structure is deformed more easily than the closed structure by an impact, that is, the cross section of the intake manifold 14 is decreased more easily.

Note, the intake manifold of the first variation of the embodiment shown in FIG. 3A can be made by facing two half cylindrical elements made of a reinforced plastic material 143 and 144 to each other and adhering them together with adhesive.

The intake manifold of the second variation of the embodiment shown in FIG. 3B can be made by injecting resin into a mold having projections.

Figure 4A:
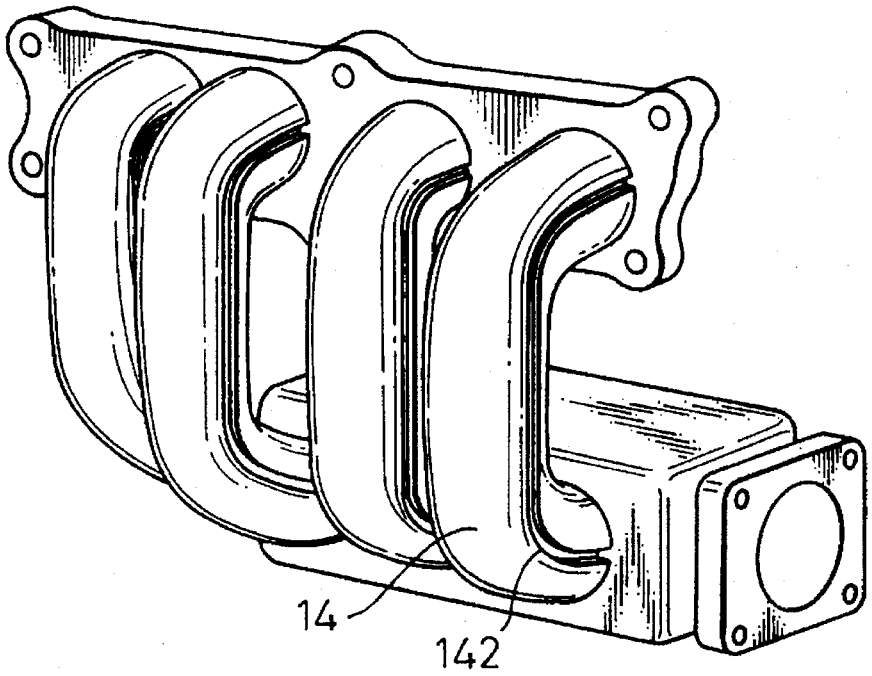
FIG. 4A and FIG. 4B are external views of an intake manifold block.
Figure 4B:
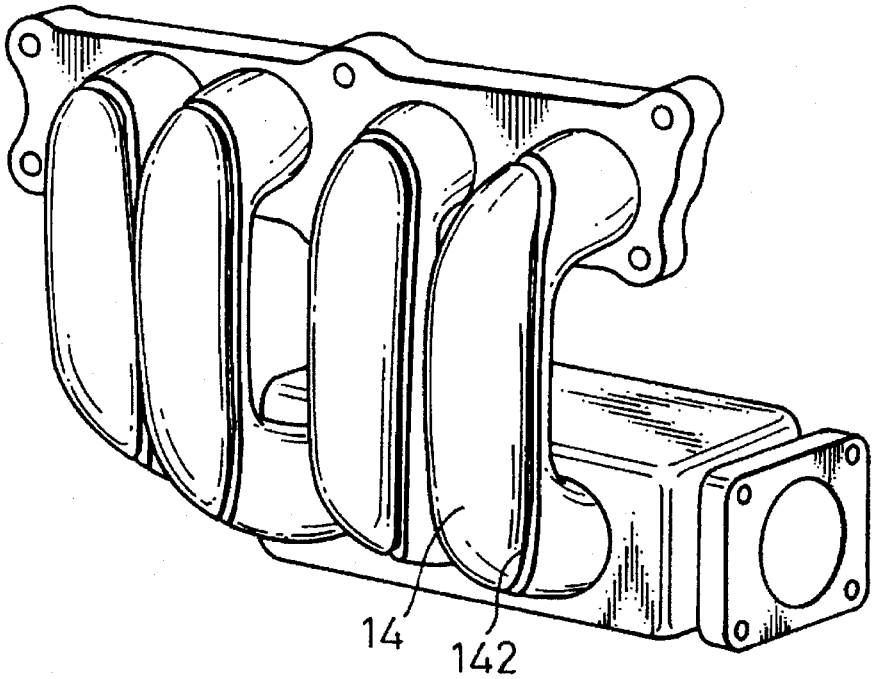

FIGS. 4A and 4B are external views of an intake manifold block applied to a tandem four-cylinder internal combustion engine. FIG. 4A shows an embodiment having a fragile zone 142 over the longitudinal direction of the intake manifold, and FIG. 4B shows an embodiment having a fragile zone 142 only in the middle portion of the intake manifold 14.

In the case of the embodiment having a fragile zone 142 over the longitudinal direction of the intake manifold as shown in FIG. 4A, the portion where the manifold 14 connects to the engine is not broken by an impact, because an acting direction of an impact force is parallel to the direction of the fragile zone at the connecting portion.

In the case of the embodiment having a fragile zone 142 only on the vertical portion of the intake manifold 14 as shown in FIG. 4B, only the portion having the fragile zone is broken by an impact. Consequently, it is not necessary to form a fragile zone over the intake manifold. The fragile zone need not be formed parallel to the axis of the intake manifold as long as the fragile zone is directed approximately in the longitudinal direction of the intake manifold.

Note, the intake manifold 14 as shown in FIG. 4A can be made by drawing with a notch cut, and by bending.

Further, the above-mentioned embodiments have circular cross sections, but the cross section of the intake manifold is not limited to a circular shape as long as it is a closed shape. A square or rectangular shape may also be applicable.

By making portion of the intake manifold 14 which connects to the cylinder head, that is, the area (C) including the fuel injection valve 16 and the fuel pipe 162, approximately horizontal and thick, the fuel injection valve 16 and the fuel pipe 162 can be protected against breaking.

This is because the direction of impact from a crash is approximately horizontal, so the impact force acts in the longitudinal direction of the intake manifold in the area (C), and the thickness of the wall in this portion is thick.

Figure 5:
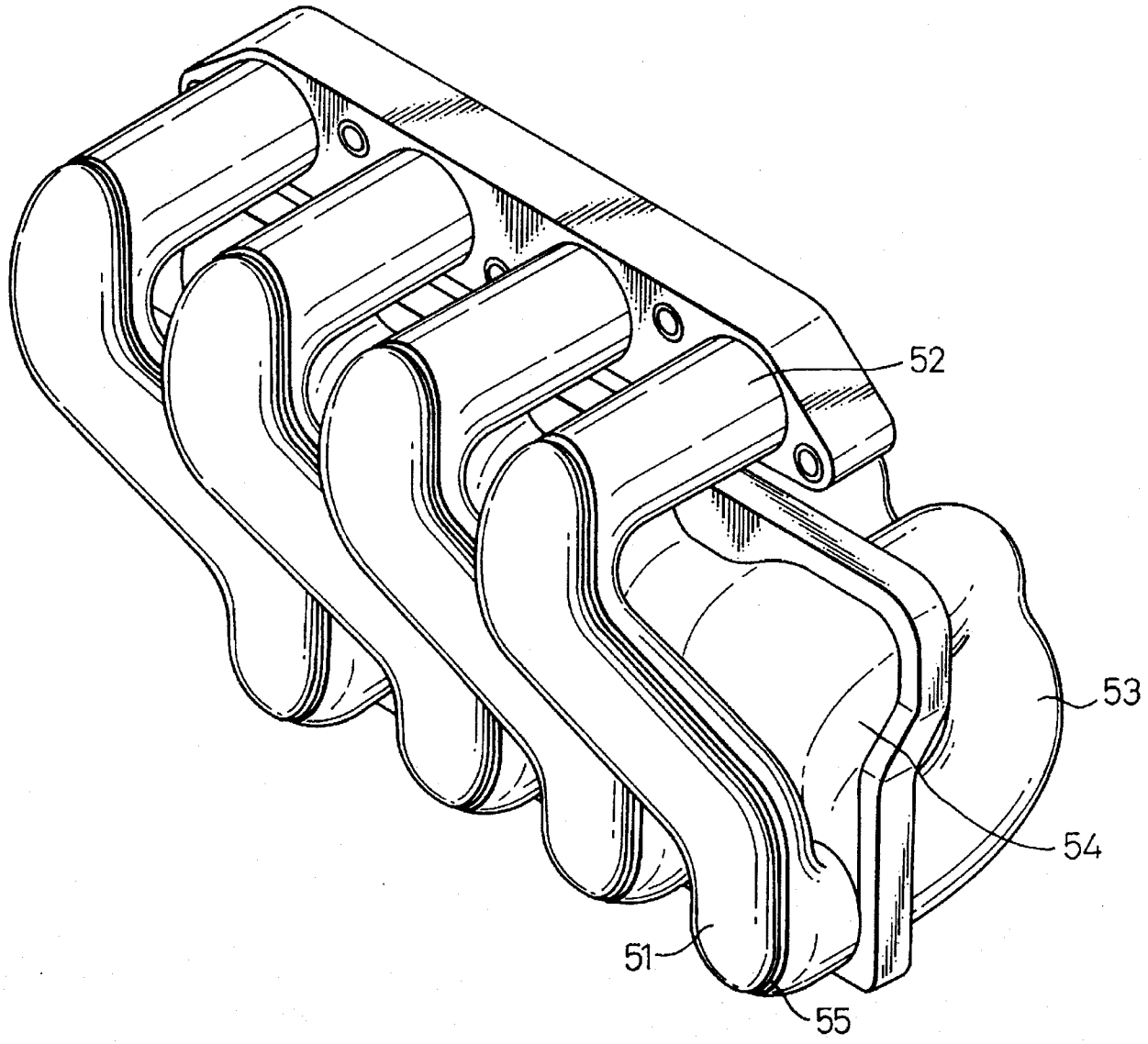
FIG. 5 is an external view of another embodiment of the present invention.

FIG. 5 shows another embodiment of this invention which mainly comprises a front part 51, a center part 52 and a rear part 53.

In this case, a surge tank 54 is included in the center part 52 which is made of resin, and the connecting portion 55 between the front part 51 and the center part 52 is a fragile zone.

In a crash, impact force is first reduced by the closed structure of the intake manifold breaking. When an impact is strong, the broken intake manifold and the surge tank 54 are crushed. Thus the compaction of the manifold can be increased.

According to the manifold of the present invention, it becomes possible to absorb an impact force by breaking the intake manifold along its fragile zone extending in the longitudinal direction of the intake manifold, and also becomes possible to increase crash compaction by decreasing the cubic volume of the intake manifold because it is broken so that its horizontal cross section is crushed.

I claim:

1. An intake manifold connectable to a forward-facing side of a transversely mounted engine, the manifold having at least one region of increased fragility relative to other regions of the manifold, the at least one region of increased fragility extending in a direction generally parallel to a longitudinally extending axis of the manifold.

2. The intake manifold of claim 1, wherein the at least one region of increased fragility extends over only a longitudinally central portion of the manifold.

3. The intake manifold of claim 1, wherein the at least one region of increased fragility extends over substantially the entire longitudinal length of the manifold.

4. The intake manifold of claim 1, wherein the at least one region of increased fragility comprises at least one flange extending generally parallel to the longitudinally extending axis of the manifold.

5. The intake manifold of claim 4, wherein said at least one flange is positioned at a right angle to a running direction of the automobile.

6. The intake manifold of claim 1, wherein the at least one region of increased fragility comprises at least one notch or groove extending generally parallel to the longitudinally extending axis of the manifold.

7. The intake manifold of claim 1, wherein the at least one region of increased fragility comprises at least one lap joint extending generally parallel to the longitudinally extending axis of the manifold.

8. The intake manifold of claim 1, wherein the at least one region of increased fragility comprises at least one seam extending generally parallel to the longitudinally extending axis of the manifold.

* * * * *